US006612473B1

(12) United States Patent
Newby et al.

(10) Patent No.: US 6,612,473 B1
(45) Date of Patent: Sep. 2, 2003

(54) ASYMMETRICAL END-LOADABLE CARTON FOR ROLLED SHEET MATERIALS

(75) Inventors: Stephen Kreg Newby, West Chester, OH (US); Kent Robert Wahl, Cincinnati, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 0 days.

(21) Appl. No.: 09/266,460

(22) Filed: Mar. 11, 1999

(51) Int. Cl.[7] ..... B65H 35/10

(52) U.S. Cl. ..... 225/48; 225/50; 242/588.3; 206/389

(58) Field of Search ..... 225/43, 46, 47, 225/48, 50, 51, 52; 242/588.3, 588.6, 596.7, 596.8; 206/389, 409

(56) References Cited

U.S. PATENT DOCUMENTS

| | | | | | |
|---|---|---|---|---|---|
| 446,373 | A | * | 2/1891 | Whitney | 242/588.6 |
| 686,324 | A | * | 11/1901 | Mckay | 242/588.6 |
| 1,127,053 | A | * | 2/1915 | Macdonald | 242/588.3 |
| 1,465,786 | A | | 8/1923 | Wheildon | |
| 1,479,960 | A | | 1/1924 | Flynn | |
| 1,560,555 | A | | 11/1925 | Flynn | |
| 1,673,426 | A | | 6/1928 | Tinsley | |
| 1,897,143 | A | | 2/1933 | Powell | |
| 1,991,812 | A | | 2/1935 | Marcalus | 206/58 |
| 2,031,033 | A | * | 2/1936 | Denebeim | 225/47 |
| 2,250,236 | A | | 7/1941 | Russell | 206/58 |
| 2,314,631 | A | | 3/1943 | Ray | 229/14 |
| 2,433,445 | A | | 12/1947 | Elsman | 206/58 |
| 2,472,521 | A | * | 6/1949 | Danenbauer | 225/47 |
| 2,474,783 | A | | 6/1949 | Gluck | 206/58 |
| 2,507,403 | A | | 5/1950 | Gluck | 206/58 |
| 2,545,802 | A | | 3/1951 | Bergstein | 229/31 |
| 2,659,525 | A | | 11/1953 | Wikstrom | 229/33 |
| 2,717,074 | A | | 9/1955 | Williamson et al. | 206/58 |
| 2,741,418 | A | | 4/1956 | Van Rosen | 229/45 |

(List continued on next page.)

FOREIGN PATENT DOCUMENTS

| | | | | |
|---|---|---|---|---|
| DE | 2356245 | * | 7/1975 | 242/596.7 |
| EP | 0083037 | | 12/1982 | B26F/3/02 |
| EP | 135895 | | 9/1983 | B65H/18/28 |
| EP | 0352634 | | 7/1989 | B65D/85/672 |
| FR | 542180 | * | 8/1922 | 242/588.6 |
| FR | 625767 | * | 8/1927 | 225/43 |
| FR | 2 332 218 | | 12/1975 | B65H/75/32 |
| GB | 12341 A | * | of 1914 | 242/588.6 |
| GB | 352277 | | 7/1931 | |
| GB | 1483620 | | 10/1974 | B65D/5/08 |
| GB | 1499108 A | | 1/1978 | |
| JP | 6-247441 | | 9/1964 | B65D/5/72 |
| SE | 38587 | * | 3/1915 | 242/588.6 |

*Primary Examiner*—Kenneth E. Peterson
*Assistant Examiner*—Omar Flores Sánchez
(74) *Attorney, Agent, or Firm*—Stephen T. Murphy; David M. Weirich; Ken K. Patel

(57) ABSTRACT

The present invention relates to dispensing cartons for sheet materials such as polymeric sheets, metallic foils, and other sheet materials, particularly those suitable for use in the containment and protection of various items including perishable materials. The present invention further relates to such cartons which permit end-loading of the roll of product into the carton during the manufacturing process. The present invention provides an asymmetrical carton for containing and dispensing a roll of sheet material. The carton has a longitudinal axis, and has both an erected condition and a flattened condition. The carton when erected forms a cylindrical structure having an asymmetrical polygonal cross-section formed from a plurality of substantially planar side panels. The carton has fold lines defined by the intersection of adjacent side panels, and is foldable into a flattened condition by folding the carton at two fold lines to form a substantially planar structure.

1 Claim, 6 Drawing Sheets

U.S. PATENT DOCUMENTS

| | | | | | |
|---|---|---|---|---|---|
| 2,766,877 | A | | 10/1956 | Burbank | 206/58 |
| 2,771,186 | A | | 11/1956 | Burbank | 206/58 |
| 2,857,047 | A | | 10/1958 | Edelson | 206/58 |
| 2,888,180 | A | | 5/1959 | Kinker, Jr. | 225/39 |
| 2,889,098 | A | | 6/1959 | Durdan | |
| 3,128,025 | A | | 4/1964 | Buttery et al. | 225/48 |
| 3,129,869 | A | | 4/1964 | Kirkwood et al. | 229/51 |
| 3,129,870 | A | | 4/1964 | Kirkwood et al. | 229/51 |
| 3,134,980 | A | | 5/1964 | Alexander | 156/220 |
| 3,184,053 | A | | 5/1965 | Eldridge | 206/52 |
| 3,184,147 | A | | 5/1965 | Wolowicz | 229/51 |
| RE25,876 | E | | 10/1965 | Buttery et al. | 225/48 |
| 3,224,574 | A | | 12/1965 | McConnell et al. | 206/56 |
| 3,228,519 | A | | 1/1966 | Dong et al. | 206/58 |
| 3,246,742 | A | | 4/1966 | Coe | 206/58 |
| 3,283,991 | A | | 11/1966 | Hughes | 229/51 |
| 3,404,829 | A | | 10/1968 | Stone | 229/44 |
| 3,432,090 | A | | 3/1969 | Engel | 229/51 |
| 3,467,298 | A | | 9/1969 | Wysocki | 229/41 |
| 3,514,032 | A | | 5/1970 | Pierce | 229/37 |
| 3,567,552 | A | | 3/1971 | Heuff et al. | 156/468 |
| 3,592,340 | A | | 7/1971 | Hoey | 206/59 |
| 3,698,548 | A | | 10/1972 | Stenzel et al. | 206/58 |
| 3,738,564 | A | | 6/1973 | Persson | 229/36 |
| 3,777,957 | A | | 12/1973 | Buttery | 225/50 |
| 3,792,770 | A | | 2/1974 | Freeman | 206/58 |
| 3,873,017 | A | | 3/1975 | Blatt | 229/41 C |
| 3,910,486 | A | | 10/1975 | Stone | 229/51 TC |
| 3,945,495 | A | | 3/1976 | Carmody et al. | 206/397 |
| 3,960,272 | A | | 6/1976 | Hartbauer et al. | 206/389 |
| 3,971,505 | A | | 7/1976 | Ohkubo | 229/45 R |
| 3,979,050 | A | | 9/1976 | Cilia | 229/66 |
| 3,991,878 | A | | 11/1976 | Serio, Jr. et al. | 242/55.53 |
| 3,994,396 | A | | 11/1976 | Reilly et al. | 206/389 |
| 4,015,711 | A | | 4/1977 | Mason | 206/413 |
| 4,029,264 | A | | 6/1977 | Reese | 242/1 |
| 4,048,052 | A | | 9/1977 | Tolaas | 206/625 |
| 4,148,395 | A | | 4/1979 | Syracuse et al. | 206/414 |
| 4,150,748 | A | | 4/1979 | Mueller | 206/624 |
| RE30,168 | E | | 12/1979 | Mason | 206/413 |
| 4,276,371 | A | | 6/1981 | Scott | 430/501 |
| 4,298,123 | A | | 11/1981 | Roccaforte et al. | 206/396 |
| 4,314,643 | A | | 2/1982 | Forbes, Jr. | 206/626 |
| 4,326,634 | A | | 4/1982 | Meyers | 206/626 |
| 4,359,182 | A | | 11/1982 | Perkins, Jr. | 229/45 R |
| 4,371,104 | A | | 2/1983 | Korte | 225/48 |
| 4,399,935 | A | | 8/1983 | Nelder | 225/49 |
| 4,405,066 | A | | 9/1983 | Roccaforte | 225/43 |
| 4,426,029 | A | | 1/1984 | Kamp | 225/49 |
| 4,431,139 | A | | 2/1984 | Barnsbee et al. | 242/55.53 |
| 4,436,206 | A | | 3/1984 | Kuchenbecker | 206/625 |
| 4,444,313 | A | | 4/1984 | Tyson | 206/397 |
| 4,450,996 | A | | 5/1984 | Kamp | 225/43 |
| 4,505,387 | A | | 3/1985 | Seto | 206/414 |
| 4,506,816 | A | | 3/1985 | Roccaforte | 225/48 |
| 4,512,462 | A | | 4/1985 | Dills | 206/53 |
| 4,549,689 | A | | 10/1985 | Bailey | 229/17 S |
| 4,714,191 | A | | 12/1987 | Richardson | 229/121 |
| 4,783,672 | A | * | 11/1988 | Wirtz et al. | 354/21 |
| 4,813,539 | A | | 3/1989 | Church et al. | 206/396 |
| 4,842,211 | A | * | 6/1989 | Robbins | 242/71.1 |
| 4,905,864 | A | | 3/1990 | Balin | 220/441 |
| 4,928,827 | A | | 5/1990 | Hara | 206/416 |
| 4,956,908 | A | | 9/1990 | Morse et al. | 29/438 |
| 4,988,054 | A | | 1/1991 | Morse et al. | 242/71.7 |
| 5,022,524 | A | | 6/1991 | Grady | 206/395 |
| 5,040,722 | A | | 8/1991 | Fromion et al. | 229/117.17 |
| 5,078,311 | A | | 1/1992 | Taguchi et al. | 225/43 |
| 5,121,839 | A | | 6/1992 | Lapp | 206/408 |
| 5,135,784 | A | | 8/1992 | Okumura | 428/34.2 |
| 5,141,108 | A | | 8/1992 | Roccaforte | 206/396 |
| 5,145,109 | A | | 9/1992 | Faulstick | 229/145 |
| 5,156,901 | A | | 10/1992 | Tanaka | 428/182 |
| 5,161,734 | A | | 11/1992 | Ruehl et al. | 229/227 |
| 5,169,484 | A | | 12/1992 | Isowa et al. | 156/471 |
| 5,205,478 | A | | 4/1993 | Wiscusen, III et al. | 229/145 |
| 5,226,571 | A | | 7/1993 | Eastwood et al. | 225/49 |
| 5,259,550 | A | | 11/1993 | Kuchenbecker | 229/109 |
| 5,299,734 | A | | 4/1994 | Lane | 229/120.32 |
| 5,306,224 | A | | 4/1994 | Okumura | 493/56 |
| 5,326,021 | A | | 7/1994 | Farrell et al. | 229/109 |
| 5,366,775 | A | | 11/1994 | Kao | 428/40 |
| 5,452,797 | A | | 9/1995 | Pollard | 206/416 |
| 5,484,082 | A | | 1/1996 | Casper et al. | 221/305 |
| 5,531,393 | A | | 7/1996 | Salzsauler et al. | 242/160.4 |
| 5,555,978 | A | | 9/1996 | Elsner | 206/410 |
| 5,620,128 | A | * | 4/1997 | Dingman et al. | 225/43 |
| 5,628,451 | A | | 5/1997 | Neary | 229/114 |
| 5,634,588 | A | | 6/1997 | Jorgensen-Beck et al. | 229/148 |
| 5,653,384 | A | | 8/1997 | Shaikh | 229/225 |
| 5,707,004 | A | | 1/1998 | Cai | 229/148 |
| 5,775,577 | A | | 7/1998 | Titus | 229/403 |
| 5,788,102 | A | | 8/1998 | Hall et al. | 229/225 |
| 5,806,786 | A | | 9/1998 | Abe et al. | 242/588.6 |
| 5,848,748 | A | | 12/1998 | Bouraoui et al. | 229/125.42 |

* cited by examiner

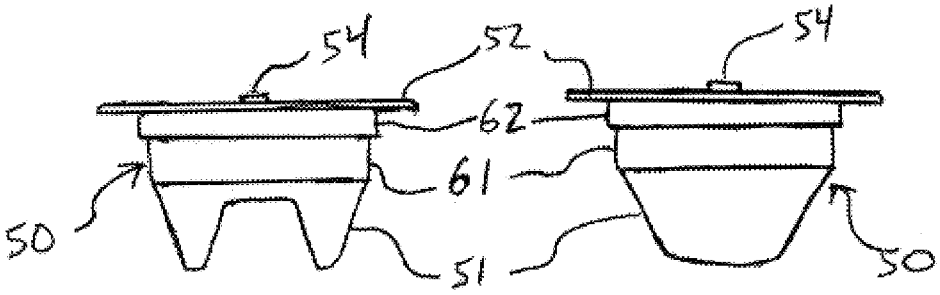
FIG. 6
FIG 7
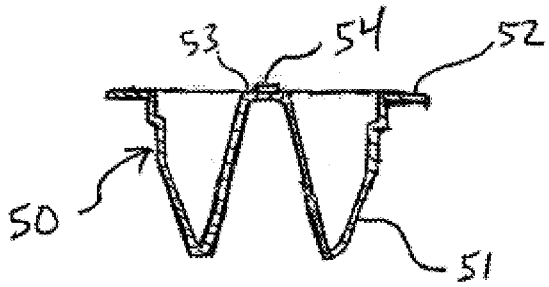
FIG. 8
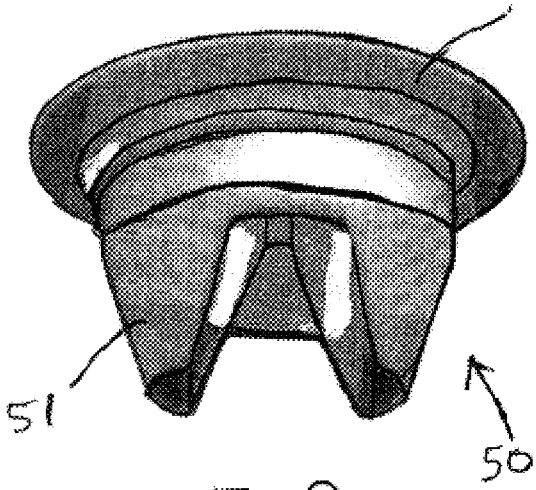
FIG. 9
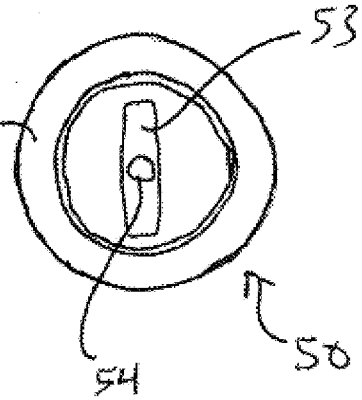
FIG 10

ASYMMETRICAL END-LOADABLE CARTON FOR ROLLED SHEET MATERIALS

FIELD OF THE INVENTION

The present invention relates to dispensing cartons for sheet materials such as polymeric sheets, metallic foils, and other sheet materials, particularly those suitable for use in the containment and protection of various items including perishable materials. The present invention further relates to such cartons which permit end-loading of the roll of product into the carton during the manufacturing process.

BACKGROUND OF THE INVENTION

Sheet-like materials for use in the containment and protection of various items, as well as the preservation of perishable materials such as food items, are well known in the art. Such materials can be utilized to wrap items individually and/or can be utilized to form a closure for a semi-enclosed container.

One class of such materials in common use today comprises those of various compositions formed into a thin, substantially two-dimensional, conformable web commonly supplied in rolled form. Common examples of such materials are polyvinyl chloride (PVC), polyvinylidene chloride (PVDC), polyethylene (PE), polypropylene (PP), aluminum foil, coated (waxed, etc.) and uncoated paper, and the like. Another recently-developed class of materials for similar applications comprises a three-dimensional, conformable web comprising an active substance such as adhesive on at least one surface protected from external contact by the three-dimensional surface topography of the base material.

With such materials, it is commonplace to provide a carton for containing and dispensing these sheet materials. Cartons of conventional design are typically fashioned from a paperboard material which is cut and folded to form a box-like construction when edges and flaps are secured to one another. The sheet material is frequently wound upon a plastic or paperboard tube to form a cored roll. A wide variety of carton materials and sheet material/roll configurations may be suitable for various applications.

In order to provide an aesthetically pleasing and easy to grasp carton shape, particularly for larger diameter rolls of product, it would be desirable to provide at least one side of the carton with reduced corner protrusion, such as a hexagonal or octagonal shape, which more closely approximates a curved surface and therefore more closely approximates the curved shape of a consumer's hand when grasping the carton. At the same time, however, a symmetrically-shaped hexagonal or octagonal carton is more prone to rolling over due to its more nearly circular cross-section. Accordingly, it would be desirable to retain some of the stability characteristics provided by a square or rectangular carton which has a high degree of corner protrusion to resist rolling over.

Most asymmetrically shaped cartons such as a semi-hexagon (with half of the cross-section being hexagonal and half being rectangular) are incompatible with end-loaded cartoners and require the use of a top-loader design. More specifically, end-loaded cartoners rely upon the ability of the carton blank to be folded upon itself and glued along a glue seam to form a flattened tubular/cylindrical structure which can then be erected to its desired final cross-section, the roll of product inserted from one end, and the end flaps glued shut. If a carton cannot be assembled into such a flattened and then erected tubular structure due to the geometry of the side surfaces, the carton must be assembled in such as way as to permit loading the roll of product through one of the sides (typically the "top") prior to final assembly rather than being inserted through one end. Top loaders are typically slower in operation than end loaders, leading to reduced output and are typically less reliable.

Most cartons in the prior art lack any feature for permitting the consumer to rotate the roll of product from the exterior of the carton to either rotate the roll to expose the end of the web of material or to rotate the roll to wind up excess sheet material and draw the end of the web back toward or into the carton. Many cartons rely upon the weight of the product roll itself to maintain it in its orientation within the carton, and the roll may move about within the carton during use.

Typical cartons in the prior art also utilize interlocking flaps or other devices to hold the carton lid in a closed condition between uses. However, such devices are often comparatively fragile in service and/or difficult to manufacture, and consequently some cartons omit such locking features entirely.

Accordingly, it would be desirable to provide an asymmetrical carton which is compatible with end-loading cartoners.

It would further be desirable to provide such a carton having additional features to facilitate location of the end of the roll of product and a releasable lid locking device.

It would also be desirable to provide such a carton which may be readily and economically manufactured and utilized for containing and dispensing sheet materials.

SUMMARY OF THE INVENTION

The present invention provides an asymmetrical carton for containing and dispensing a roll of sheet material. The carton has a longitudinal axis, and has both an erected condition and a flattened condition. The carton when erected forms a cylindrical structure having an asymmetrical polygonal cross-section formed from a plurality of substantially planar side panels. The carton has fold lines defined by the intersection of adjacent side panels, and is foldable into a flattened condition by folding the carton at two fold lines to form a substantially planar structure.

BRIEF DESCRIPTION OF THE DRAWINGS

While the specification concludes with claims particularly pointing out and distinctly claiming the present invention, it is believed that the present invention will be better understood from the following description in conjunction with the accompanying Drawing Figures, in which like reference numerals identify like elements, and wherein:

FIG. 6 is an elevational view of an end cap in accordance with the present invention;

FIG. 7 is an elevational view of the end cap of FIG. 6 taken 90 degrees from the view of FIG. 6;

FIG. 8 is an elevational sectional view of the end cap of FIG. 6 from the same vantage point;

FIG. 9 is a bottom perspective view of the end cap of FIG. 6;

FIG. 10 is a top plan view of the end cap of FIG. 6;

DETAILED DESCRIPTION OF THE INVENTION

Figure 1:
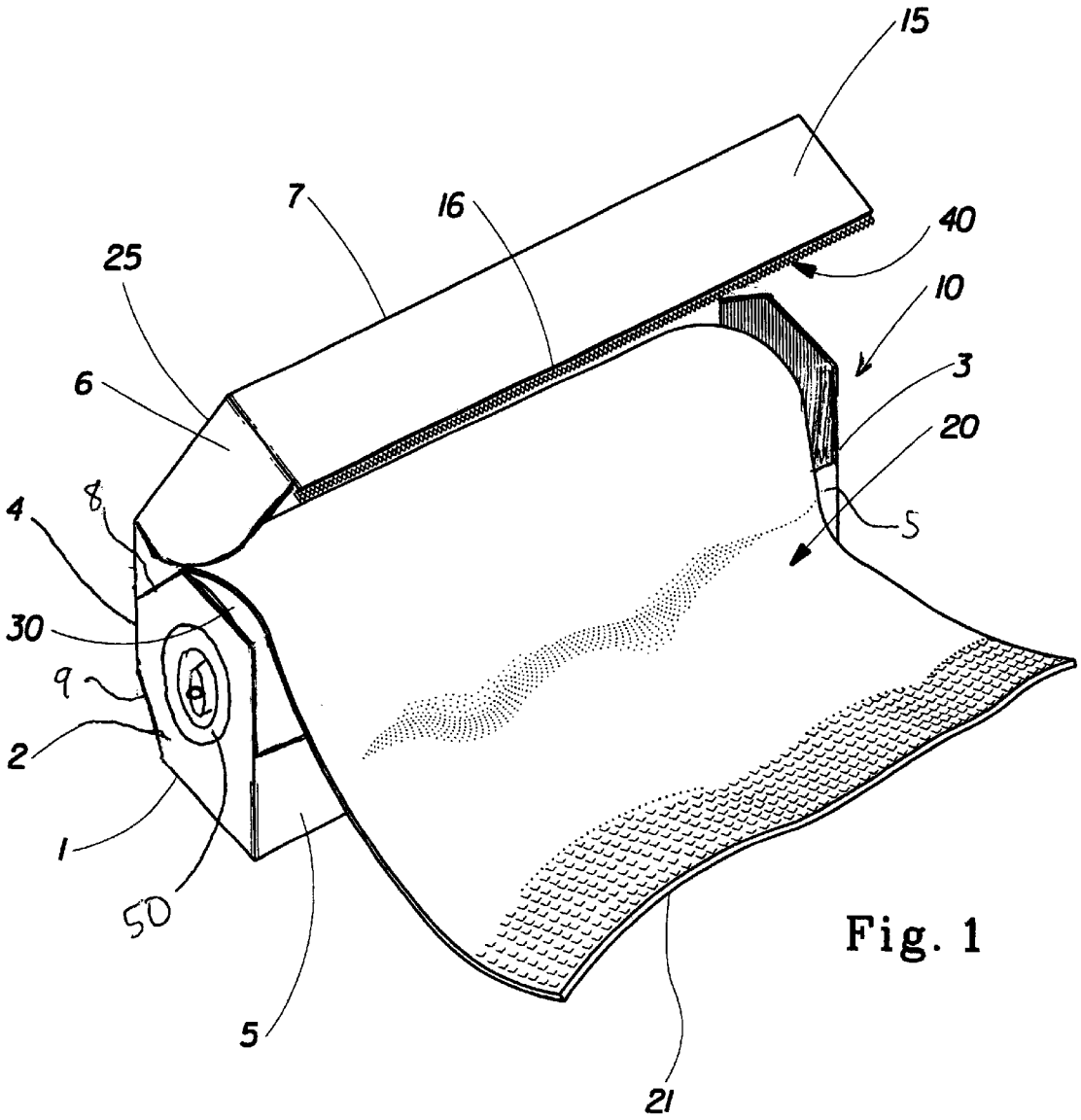
FIG. 1 is a perspective view of a carton in accordance with the present invention for dispensing a web of sheet material.

FIG. 1 depicts a carton 10 according to the present invention which is suitable for containing and dispensing a web 20 of sheet material from a roll 30. The carton 10 includes a bottom panel 1, two end panels 2 and 3, and side panels 4, 5, 8, and 9, as well as a lid 25 which includes top panel 7 and flap 15. In the embodiment shown, the flap 15 overlaps at least a portion of the front side panel 5 when the lid is in the closed configuration. Gussets 6 at each end of the lid 25 aid in maintaining the flap 15 in a perpendicular relationship to the top panel 7 of the lid 25. Panels 1, 4, 5, 7, 8, and 9 all function as "side" panels and are joined to one another by fold lines (or in the case of panels 5 and 15, an overlapping relationship to form a substantially planar front side referred to herein as composite front panel 5/15) to form a cylindrical structure having a polygonal cross-section. Such a cylindrical structure is enclosed by end panels 2 and 3 to form a closed carton. The centerline of the product roll (illustrated as "CL" in FIG. 5) defines a longitudinal axis of the carton and the "side" panels are all substantially parallel to the longitudinal axis and the end panels are substantially perpendicular to the longitudinal axis.

The carton 10 also includes a blade 40 for severing a desired portion of the sheet material. In the presently preferred (but only representative) configuration shown in FIG. 1, the blade 40 is located on the distal edge 16 of the flap 15 such that the teeth of the blade extend at least slightly outwardly beyond the edge of the flap in overlying relationship to the front side panel 5. In the configuration illustrated in FIG. 1, the blade is affixed to the inner surface of the flap 15 such that the teeth extend outwardly beyond the marginal edge of the flap. If desired, however, the blade 40 may be mounted either on an inside or outside surface of the carton and may be located elsewhere on the carton, such as the lower edge of the front panel 5 of the carton.

Figure 2:
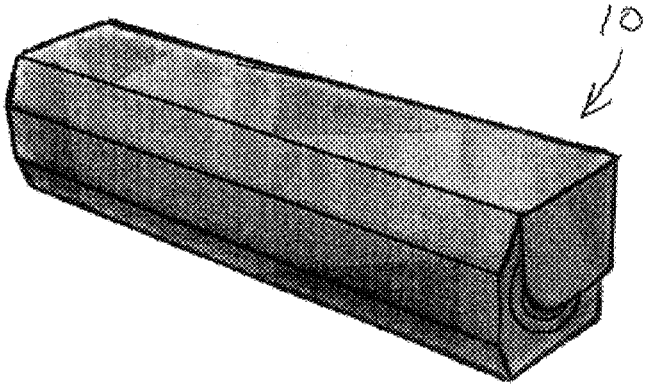
FIGS. 2 and 3 are perspective views of the carton of FIG. 1 from different vantage points to illustrate the geometry of the carton.
Figure 3:
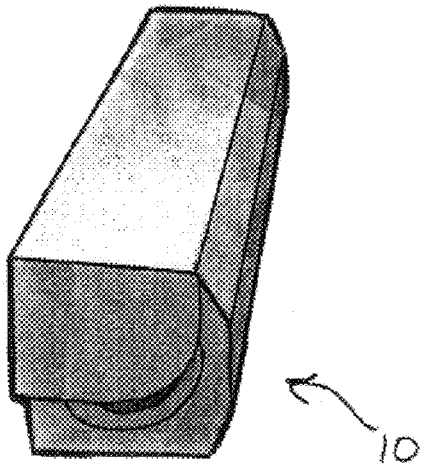
Figure 4:
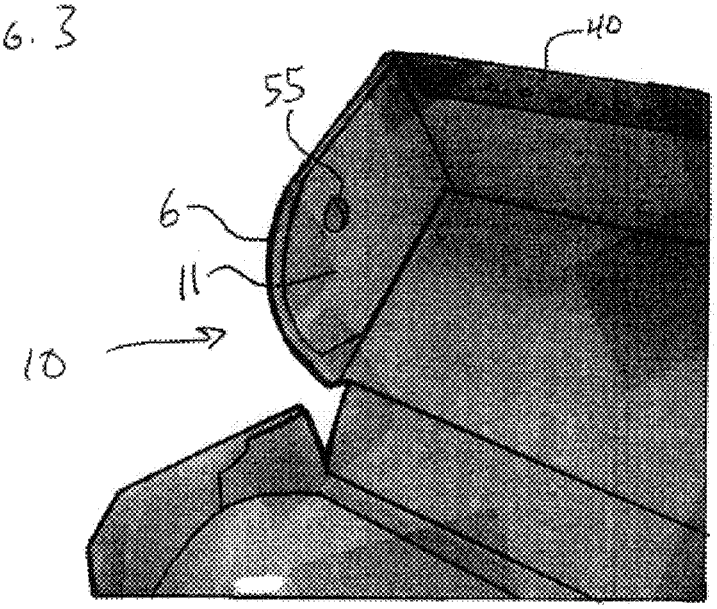
FIG. 4 is a partial perspective view of the carton of FIG. 1 with the lid in the open position to illustrate the lid portion of the preferred locking feature.

FIGS. 2 and 3 provide additional perspective views of the carton of FIG. 1 from different vantage points to better illustrate the three-dimensional geometry of the carton construction. FIG. 4 is also a partial perspective view of the carton of FIGS. 1–3, illustrating the interior elements of the lid/flap/top panel, the mounting of the blade 40, and the carton portion of the locking feature (aperture 55 in panel 11) which will be described hereafter.

In use, the web of sheet material 20 may be drawn against the blade 40 to sever a desired length of sheet material from the roll when the flap 15 is held in the closed position overlying the front panel 5 of the carton. This arrangement prevents the tail of the rolled material from being lost within the carton after severance of a length of material, since the "tail" or terminal edge of the continuous sheet material created by the severing operation will be held between the flap 15 and the front panel 5. The numeral 21 identifies the terminal edge of the sheet material, which typically comprises the "tail" remaining after the previous severing operation.

Figure 5:
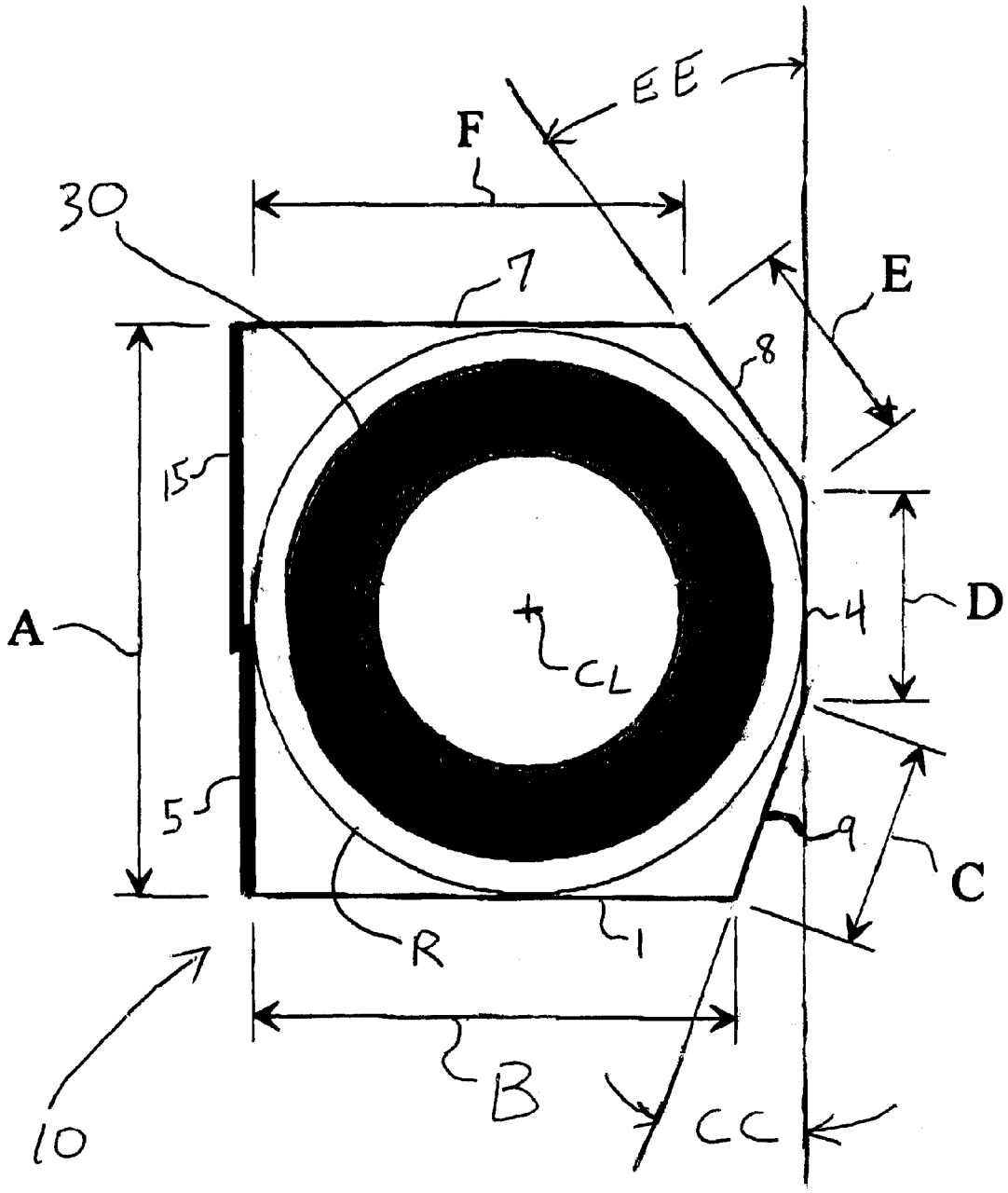
FIG. 5 is an elevational sectional view of the carton of FIGS. 1–4.

FIG. 5 is a cross-sectional view of the carton 10 of FIGS. 1–4, depicting in greater detail the dimensions and angular relationships of the various "side" surfaces of the carton. Panels 1, 5/15, and 7 are each perpendicular to one another with top and bottom panels 7 and 1, respectively, being substantially parallel to one another and joined by the front panel 5/15 which is substantially perpendicular to the panels 1 and 7. The carton is thus semi-rectangular with respect to the portion of the cross-section lying to one side of the centerline of the product roll, and has prominent protruding corners for stability when placed upon solid surfaces. The remaining side panels 4, 8, and 9 enclose the portion of the polygonal cross section opposite from the front panel 5/15 and form what may be termed a composite rear panel 4/8/9 which opposes composite front panel 5/15. While a composite panel formed from three panel elements has been illustrated, the number of panel elements may be 2, 3, 4, 5, or more as desired.

The relationship of the lengths (in the cross-sectional direction) of the side panels of the carton, as well as the angles relating various sides (such as angles CC and EE in FIG. 5) are such that the carton may be folded to form a flattened cylindrical structure via fold lines at the junctures of sides 7/15 and 1/9. Therefore, in both folded/flattened and erected states the dimensional relationships are such that the sum of the lengths A+B equals the sum of the remaining lengths C+D+E+F, or in other words A+B=C+D+E+F. However, in order to maintain the desired orthogonal relationships of the top, bottom and front panels in the erected condition (such that the carton is semi-rectangular) the sum of the projected lengths of the sides 4, 8, and 9 in the A direction must be equal to length A. It is presently preferred that side 4 be substantially parallel to side 5/15 for purposes of packaging and stacking pluralities of cartons 10. Therefore, the sum of length B plus the projected length of side 9 in the B direction must be equal to the sum of length F plus the projected length of side 8 in the F direction.

The relationships of the sides to one another are such that the carton when folded from a unitary blank of material can have the ends of the blank readily glued to one another to form a continuous structure by joining edges which naturally align when the carton is in its flattened condition. The carton can then be re-oriented to an erected condition in conventional fashion to its final cross-section and the assembly can then be completed by closing and securing the end panels after the product roll has been inserted and positioned/secured via the core end caps.

The carton of the present invention has a cross-section perpendicular to the longitudinal axis which is asymmetrical, which as defined herein means that there is no plane which can be drawn through the package parallel to the longitudinal axis which will divide the carton into symmetrical halves.

In a presently preferred embodiment, dimensional values for A–F in FIG. 5 are 2.75 inches, 2.38 inches, 1.00 inches, 1.00 inches, 1.00 inches, and 2.13 inches, with a maximum roll diameter of 2.40 inches and a maximum circumscribed diameter (diameter of circle illustrated as "R") of 2.71 inches, providing a clearance between product and carton of about 0.31 inches. The angles CC and EE are 19 degrees and 36 degrees respectively. The overall carton height and width, respectively, are 2.75 inches and 2.71 inches. The outside diameter of the core tube for the product roll is 1.5 inches, and the overall carton length is approximately 12.0 inches.

As shown in FIG. 1, the carton of the present invention preferably includes core end caps 50 which secure and retain the roll 30 within the carton 10. FIGS. 6–10 depict various views of a preferred embodiment of a core end cap 50. As shown in FIGS. 6 and 7, the core end cap preferably includes a tapered guide portion 51 which permits ease of alignment when inserted into the ends of the roll to hold the roll in position within the carton. The core end cap 50 also includes a flange 52 which prevents the core end cap 50 from being inserted too far into the carton. The cylindrical core support 61 tightly engages the core of the product roll to both maintain the end caps within the carton and to secure the roll to the carton. Shoulder portion 62 provides an abutment to prevent over-insertion of the end caps into the core and provides a bearing surface for engaging the apertures (shown in FIG. 11) in the ends of the carton.

The core end cap 50 further includes, as shown in FIGS. 8 and 10, a grip portion 53 which is preferably unitarily formed with the end cap to provide an element which is substantially flush with the outer surface of the flange 52, or recessed within the flange 52, yet may easily be grasped and manipulated by a consumer to rotate the roll of product to locate the end of the web and/or retract extra web material back into the carton by winding it upon the roll. Core end cap 50 also preferably includes a small projecting button 54 or similar protrusion which is substantially centrally located and protrudes outwardly beyond other features of the core end cap such as the flange and grip portion. Button 54 engages a corresponding recess or aperture 55 in a panel 11 on an interior surface of the gusset 6 to provide a lid lock-down feature to maintain the carton in a closed but easily accessible orientation. Button 54 may be unitarily formed with the end cap or may be a separate element secured thereon. FIG. 8 is an elevational cross-sectional view of the end cap 50 taken from the same vantage point as FIG. 6, and FIG. 9 is a perspective view of the lower portion of the end cap.

The end caps may be made from any suitable material, although unitarily formed caps thermoformed from high impact polystyrene have been found particularly suitable.

Blades utilized with cartons in accordance with the present invention preferably utilize tooth design parameters which have been selected and optimized to provide superior severing performance under in-use conditions with a wide variety of materials, particularly comparatively low modulus (low force to elongate) sheet materials and sheet materials of three-dimensional geometry which exhibit a lower modulus than their compositional material would exhibit in two-dimensional form. Such blades are described in greater detail in commonly-assigned U.S. Pat. No. 5,839,634, issued Nov. 24, 1998 to Pollard, et al., the disclosure of which is hereby incorporated herein by reference.

Blades suitable for use with cartons in accordance with the present invention may be fabricated from a wide variety of suitable materials, such as metals, plastics, glass, rubber, paperboard, wood, ceramic, etc. However, for reasons of economy and manufacturing expediency the use of tin-plated steel such as is commonly commercially available is presently preferred.

The blades may be manufactured by any suitable method commonly utilized in the art for the particular material desired, such as molding (injection or otherwise), casting, sintering, grinding, stamping, forging, machining, electrical discharge machining, etching, hobbing, etc.

Figure 11:
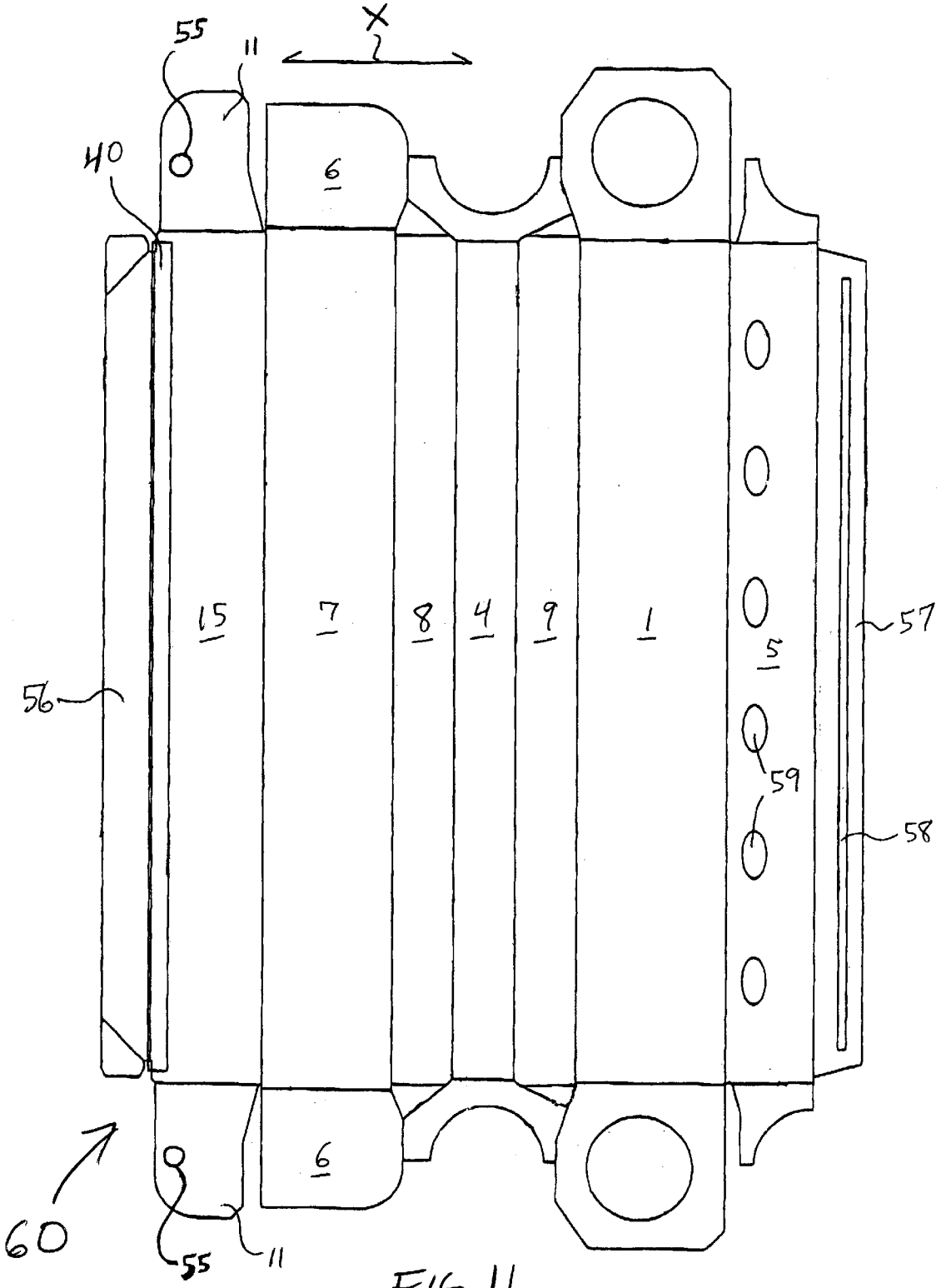
FIG. 11 is a plan view of a blank suitable for forming the carton of FIGS. 1–4.

FIG. 11 illustrates a blank 60 suitable for forming the carton illustrated in FIGS. 1–4, with the various sides and elements identified with their respective numbers as depicted in earlier FIGS. The blank 60 also includes additional tabs and panels to form surfaces for gluing and/or reinforcing other panels of the carton, as well as for retaining and supporting the core end caps. More specifically, panel 56 is joined to panel 15 along a line of weakness, preferably a line of perforations, to form a removable tear strip which protects the blade prior to use. Tear strip 56 is initially glued to front panel 5 at locations 59, which are sufficiently small as to be easily overcome to remove the tear strip. Panel 57 is folded behind panel 5 as a reinforcing element and glued along line 58. If the carton is fabricated from an oriented material such as corrugated paperboard, the direction "X" is a preferred direction for the orientation of the flutes of the material.

The cartons of the present invention may be manufactured from any suitable material, although for reasons of cost and manufacturing expediency various paperboard products have been found particularly suitable. A presently preferred type of paperboard is a type "F-Flute" material, which is a double-faced corrugated paperboard. Any desired weight of material consistent with its intended use may be utilized, and for the carton design described herein a 23 pound medium and inner liner have been found suitable.

Figure 12:
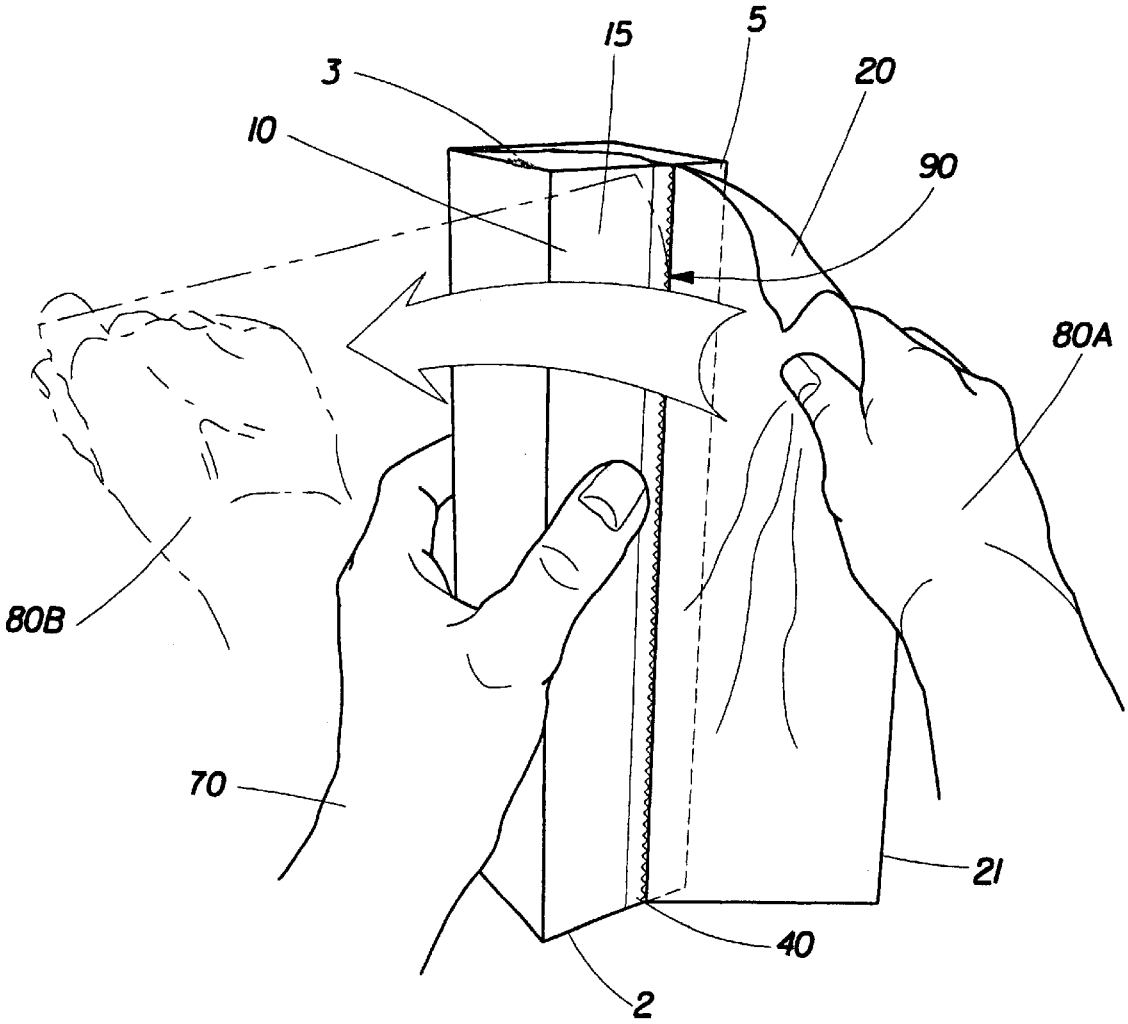
FIG. 12 is a graphical representation of a typical severing operation with a carton in accordance with the present invention.

FIG. 12 depicts a typical in-use scenario wherein a blade mounted on the carton according to the present invention is utilized to sever a desired length of sheet material from a roll of stock material. As shown in FIG. 12, a carton 10 of the type depicted in FIG. 1 is held in a closed condition in one hand 70 while the other hand grasps the terminal edge 21 of the sheet material 20. The terminal edge 21 of the sheet material is drawn outwardly until the desired length (relative to the location of the blade 40) of the sheet material extends outwardly from the roll between the blade and the front panel 5. At this point the hand reaches the location depicted by hand 80A. The grasping action of hand 70 aids in pinching the lid 15 against the front panel 5 to reduce the likelihood that the severing operation will cause the sheet material to slip relative to the blade.

To accomplish the severing of the length of sheet material, the terminal edge 21 of the sheet material is pulled back over the location of the blade 40 as indicated by the large arrow in FIG. 12 such that the material partially wraps the blade 40 and the material is drawn at an angle toward the user and upwardly from the direction of the carton 40. At this time, the hand 80A crosses over the hand 70 and reaches the location depicted by hand 80B as the tearing process progresses. Drawing the sheet material back across the blade at an angle concentrates the pulling force at the edge of the sheet material near the carton end panel 3 such that the force per unit area exerted by the sheet material over the blade teeth exceeds the penetration pressure required to pierce the sheet material. The numerical identifier 90 identifies the location of the leading edge of the tear line which is progressing downwardly in the illustration from the upper edge of the sheet material downwardly along the blade toward the lower edge of the material. The sheet material located along the tear line below the location 90 may be under little or no tension while the tension near the location 90 is maintained in excess of the required penetration pressure. When the tear line reaches the farthest edge of the material near the carton end panel 2, the separation is complete and a new terminal edge 21 is formed on the remaining sheet material at the location of the toothed side of the blade.

Cartons in accordance with the present invention may be utilized in the packaging, dispensing, and severing of a wide variety of sheet-like materials, whether predominantly two-dimensional in nature or formed into three-dimensional structures.

One material of current interest comprises a three-dimensional, conformable web comprising an active substance such as adhesive on at least one surface protected from external contact by the three-dimensional surface topography of the base material. Such materials comprise a polymeric or other sheet material which is embossed/debossed to form a pattern of raised "dimples" on at least one surface which serve as stand-offs to prevent an adhesive therebetween from contacting external surfaces until the stand-offs are deformed to render the structure more two-dimensional. Representative adhesive carrier structures include those disclosed in commonly assigned U.S. Pat. Nos. 5,662,758, issued Sep. 2, 1997 to Hamilton and McGuire, entitled "Composite Material Releasably Sealable to a Target Surface When Pressed Thereagainst and Method of Making", and 5,871,607, issued Feb. 16, 1999 to Hamilton and McGuire, entitled "Material Having A Substance Protected by Deformable Standoffs and Method of Making", and commonly-assigned, co-pending U.S. patent application Ser. No. 08/745,339, filed Nov. 8, 1996 in the names of McGuire, Tweddell, and Hamilton, entitled "Three-Dimensional, Nesting-Resistant Sheet Materials and Method and Apparatus for Making Same", 08/745,340, filed Nov. 8, 1996 in the names of Hamilton and McGuire, entitled "Improved Storage Wrap Materials".

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. An asymmetrical carton for containing and dispensing a roll of sheet material, said carton comprising:

a) a plurality of substantially planar side panels;

b) a longitudinal axis;

c) fold lines defined by an intersection of adjacent side panels said carton being foldable into said flattened condition by folding said carton at two fold lines to form a substantially planar structure, d) a pivotable lid formed from at least one of said side panels, e) a core tube for dispensing a rolled web of sheet material; and f) a pair of core end caps extending through said end panels for rotatably supporting said core tube wherein said carton has an erected condition and a flattened condition, said carton when erected forming a cylindrical structure having an asymmetrical polygonal cross-section having no internal angle less than 90° formed from the plurality of substantially planar side panels, and wherein said pivotable lid includes at least one gusset panel forming at least part of a corresponding end panel, said gusset panel including an aperture, and at least one of said pair of core end caps includes an outwardly projecting button which cooperates with said aperture to secure said pivotable lid in a closed position.

* * * * *